US008668059B2

(12) United States Patent
De La Fuente-Farias et al.

(10) Patent No.: US 8,668,059 B2
(45) Date of Patent: Mar. 11, 2014

(54) UNIT GUIDE WEAR PLATE FOR BRAKE BEAMS

(75) Inventors: Jorge Alberto De La Fuente-Farias, San Pedro Garza Garcia (MX); Jerome A Malachowski, Hamburg, NY (US)

(73) Assignee: Stucki de Mexico, S. de R.L. de C.V., N.L. (MX)

( * ) Notice: Subject to any disclaimer, the term of this patent is extended or adjusted under 35 U.S.C. 154(b) by 44 days.

(21) Appl. No.: 13/092,525

(22) Filed: Apr. 22, 2011

(65) Prior Publication Data

US 2011/0259685 A1 Oct. 27, 2011

Related U.S. Application Data

(60) Provisional application No. 61/326,778, filed on Apr. 22, 2010.

(51) Int. Cl.
*B61H 13/36* (2006.01)

(52) U.S. Cl.
USPC ..... 188/233.3; 188/209

(58) Field of Classification Search
USPC ..... 188/52, 53, 205 R, 207, 209, 212, 213, 188/219.1, 233.3; 267/151, 152, 158, 160, 267/163, 164
See application file for complete search history.

(56) References Cited

U.S. PATENT DOCUMENTS

| | | | | | |
|---|---|---|---|---|---|
| 2,499,549 | A * | 3/1950 | Walker | 188/212 |
| 2,553,345 | A * | 5/1951 | Willis | 188/212 |
| 2,808,906 | A * | 10/1957 | Busch | 188/190 |
| 2,974,758 | A * | 3/1961 | Ekholm | 188/233.3 |
| 3,020,984 | A * | 2/1962 | Le Bean | 188/212 |
| 4,471,857 | A * | 9/1984 | Murphy | 188/52 |
| 5,421,437 | A * | 6/1995 | Malachowski | 188/233.3 |
| 8,256,585 | B2 * | 9/2012 | Halford et al. | 188/233.3 |
| 2012/0037033 | A1 * | 2/2012 | Halford et al. | 105/182.1 |

* cited by examiner

*Primary Examiner* — Bradley King
*Assistant Examiner* — Nicholas J Lane
(74) *Attorney, Agent, or Firm* — Young & Thompson

(57) ABSTRACT

An improved unit guide wear plate for brake beams, which provides a brake beam centering force and aligns the movement of a brake beam end guide within the side frame of a railroad car truck so that the brake shoes can provide the maximum amount of force against the wheels when stopping the railroad car, and which is less prone to fracture than current unit guide wear plates.

4 Claims, 13 Drawing Sheets

UNIT GUIDE WEAR PLATE FOR BRAKE BEAMS

BACKGROUND OF THE INVENTION

A. Field of the Invention

The present invention is related to brake beams for railway cars, and more particularly to an improved unit guide wear plate for brake beams, which aligns the movement of a brake beam end guide within the side frame of a railroad car truck so that the brake shoes are lined up to provide the maximum amount of force against the wheels when stopping the railroad car. Additionally, the unit guide wear plate of the present invention improves the lateral alignment of the brake shoes on the wheels.

B. Background of the Invention

There are well known brake heads assemblies for railway cars by which a brake shoe is pressed against a wheel in order to decrease or stop the rotational speed of the wheel and of the railway car.

Generally, two brake head assemblies are held by a structure called a "brake beam" mounted transversely in the truck of a railway car and are pinned to levers, which apply forces in order to press the brake shoes against the wheels.

The brake beam generally comprises, a tension member having two opposed ends; a compression member also having two opposed ends respectively coupled to the ends of the tension member; a brake head subassembly linked to each end of the compression member, two end extensions each coupled to an end of the compression member by which the brake beam is supported in the truck of a railway car; and a fulcrum coupled to the compression and tension members, so that the fulcrum remains between the tension member and the compression member. The end extensions of the brake beam are confined within respective pocket guides of the truck.

The lateral angle between a brake beam and a lever of the rigging system causes the brake beams to shift sideways when the braking force is applied, and to impinge on the side frames of the truck at diagonally opposed locations.

Current available brake shoes, are hardened in order to extend their lifetime, and designed to smooth any surface defect on the truck wheels (known as tread conditioning shoes). Although the cost of a new design brake shoe is approximately six times higher than the cost of a conventional brake shoe, it is in high demand since replacing the wheels is the costliest and most important maintenance element in a railway car.

New truck designs are made more flexible, in an effort to reduce the wear of the wheel treads, but because of such flexibility, the lateral movement of brake beams is greater.

When a brake beam moves laterally, one of the brake shoes can make contact with the flange of one wheel on the corresponding axle (overriding condition). This together with the new brake shoe design, and the flexibility of the new truck designs, can cause excessive wear of the flange and a premature replacement o the wheel. Meanwhile, the other brake shoe, extends beyond the opposite wheel tread (overhanging condition). As this brake shoe wears out, it begins to wear and heat the lateral face of the corresponding wheel thus creating micro cracks, which can be confused with profound cracks upon inspection, thus condemning the wheel.

In view of the above referred problems, there have been developed devices for centering the brake beam and avoiding its lateral displacement, such as the U.S. Pat. No. 5,421,437 which discloses a unit guide wear plate which aligns the movement of a brake beam end guide within the side frame of a railroad car truck so that the brake shoes can provide the maximum amount of force against the wheels when stopping the railroad car. The unit guide wear plate is comprised of a wear plate body, having a u-shaped cross section, a first side wall, having a first inner surface and a first outer surface; a second side wall, having a second inner surface and a second outer surface; a third side wall having a third inner surface and a third outer surface; wherein the first side wall is located such that it is attached to the third side wall opposite the second side wall; a first flange extension protruding from the first side wall and a second flange extension protruding from the second side wall; a pair of dimples arising out of the second outer surface for securing the unit guide wear plate within a railroad car side frame; a spring tang for providing a lateral force on a brake beam end guide as it lies within the unit guide wear plate body; and a first ramp extending outward from the first inner surface and a second ramp extending outward from the second inner surface, for aligning the brake beam end guide within the unit guide wear plate body. U.S. Pat. No. 5,421,437 discloses many embodiments of the unit guide wear plate, including the substitution of the spring tang with a metallic insert as shown in FIG. 5 of U.S. Pat. No. 5,421,437.

However, the unit guide wear plate disclosed in U.S. Pat. No. 5,421,437 has several problems since it tends to fracture while in service and is not strong enough to really align the brake beam.

In view of the above referred problems applicant developed an improved unit guide wear plate in which the spring tang is wider and flatter, thus providing a wider surface for pushing the ends of any kind of end extension.

The improved unit guide wear plate of the present invention has an insert preferably made of an elastomeric material that works together with the spring tang, providing additional resisting force and lowers stresses in the spring tang. This new feature avoids the observed fracture of the unit guide wear plate, tang while developing a higher brake beam centering force.

SUMMARY OF THE INVENTION

Figure 1:
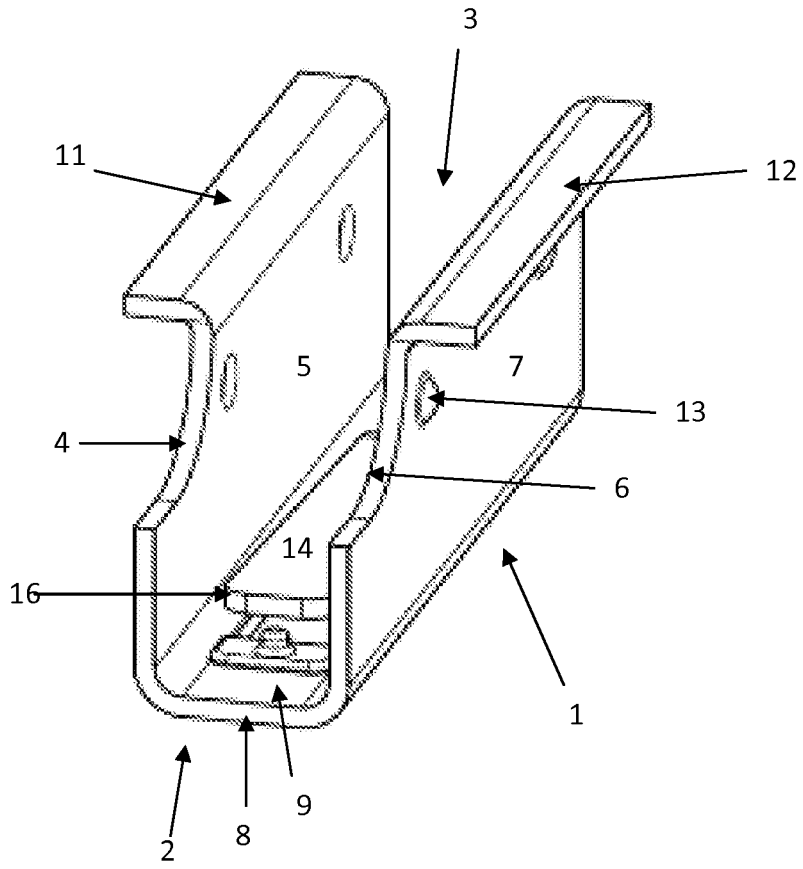
FIG. 1 is a perspective view of a preferred embodiment of the unit guide wear plate of the present invention.
Figure 2:
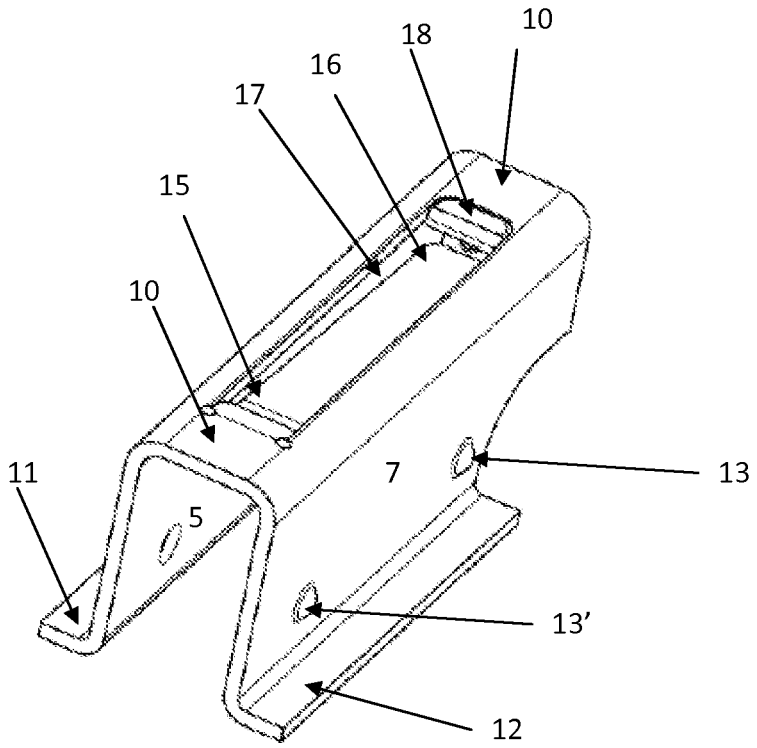
FIG. 2 is a lower perspective view of a preferred embodiment of the unit guide wear plate of the present invention.
Figure 3:
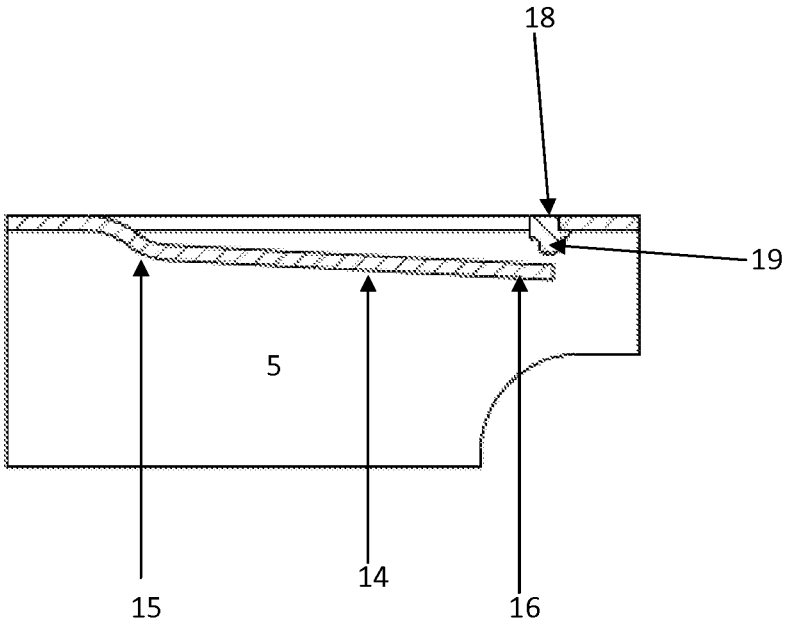
FIG. 3 is a view of the cross section of a preferred embodiment of the unit guide wear plate of the present invention.
Figure 4:
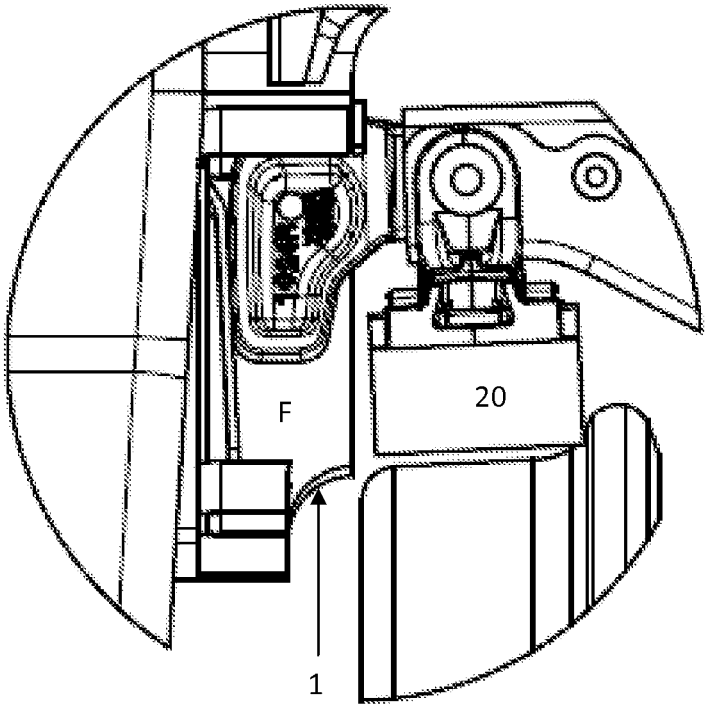
FIG. 4 is a view of a preferred embodiment of the unit wear plate of the present invention, installed in the truck of a railway car when the brakes are not applied.
Figure 5:
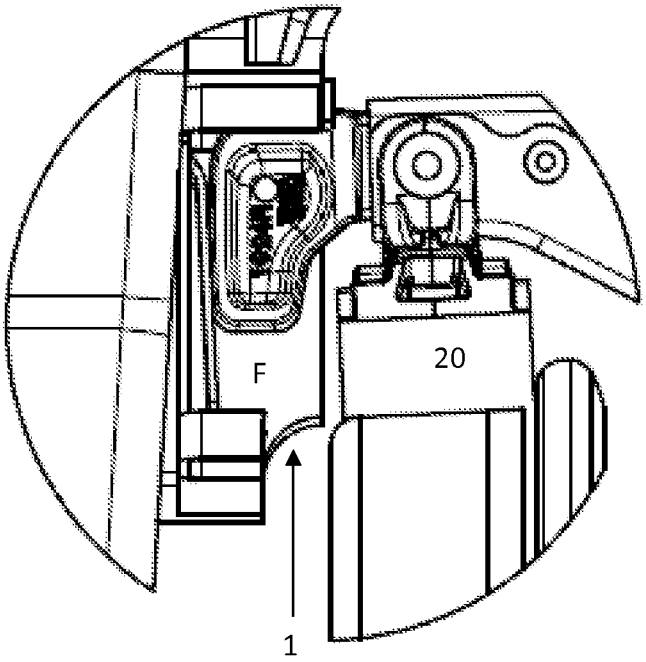
FIG. 5 is a view of a preferred embodiment of the unit wear plate of the present invention, installed in the truck of a railway car when the brakes are applied with new brake shoes.

It is therefore a main object of the present invention to provide an improved unit guide wear plate comprised of a wear plate body, having a u-shaped cross section, a first side wall, having a first inner surface and a first outer surface; a second side wall, having a second inner surface and a second outer surface; a third side wall having a third inner surface and a third outer surface; wherein the first side wall is located such that it is attached to the third side wall opposite the second side wall; a first flange extension protruding from the first side wall and a second flange extension protruding from the second side wall; a pair of dimples arising out of the second outer surface for securing the unit guide wear plate within a railroad car side frame; a spring tang for providing a lateral force on a brake beam end guide as it lies within the unit guide wear plate body, wherein the improvement comprises a wider and flatter spring tang.

It is another main object of the present invention to provide an improved unit guide wear plate of the above referred nature, wherein the improvement further comprises an insert preferably made of an elastomeric material that works together with the spring tang and provides additional centering force to the spring tang and shares the stress load together with the spring tang thus offering more effective brake beam centering when the end extension is being forced sidewards as a result of the lateral displacement of the brake beam when the braking force is applied, thus avoiding the premature fracture of the unit guide wear plate tang.

These and other objects and advantages of the improved unit guide wear plate of the present invention will become apparent to those persons having an ordinary skill in the art, from the following detailed description of the embodiments of the invention which will be made with reference to the accompanying drawings.

DETAILED DESCRIPTION OF THE INVENTION

The improved unit guide wear plate of the present invention will now be described making reference to a preferred embodiment thereof illustrated in the accompanying drawings (FIGS. 1, 2, 3, 4, 5 and 6) wherein the same signs and numbers, refer to the same parts of the shown figures, wherein the improved unit guide wear plate of the present invention comprising:

a wear plate body 1, having a u-shaped cross section, a first open end 2 and a second open end 3, comprising:

- a first side wall 4, having a first inner surface 5 and a first outer surface "F";
- a second side wall 6, having a second inner surface (not shown) and a second outer surface 7;
- a third side wall 8 having a third inner surface 9 and a third outer surface 10;
- wherein the first side wall 4 is located such that it is attached to the third side wall 8 opposite the second side wall 6 in a "U" fashion, in such way that the distance between the first 4 and second side wall 6 is greater that the width of the third side wall 8;
- a first flange extension 11 protruding from the first side wall 4 and a second flange extension 12 protruding from the second side wall 6;
- a first pair of dimples 13, 13' each arising out of the second outer surface 7 and a matching second pair of dimples in the outer surface of first side wall 4(not shown), used for securing the unit guide wear plate within a railroad car side frame;

a rectangular spring tang 14 for providing a lateral force on a brake beam end guide as it lies within the unit guide wear plate body, said spring tang 14 depending from the third side wall 8, having a base 15 and an end 16 facing the first open end 2 of the wear plate body 1 and is lifted at an angle over the third inner surface 9 of the third side wall 8 in such way, that a rectangular aperture 17 is formed below the spring tang, and wherein the width of the rectangular spring tang 14 is equal to the width of the third side wall 8 from which it depends; and centering means comprising a rectangular plate 18 having a first and a second surface and an insert 19 made preferably of an elastomeric material attached to a central portion of the first surface thereof, wherein said rectangular plate 18 is attached to the third inner surface 9 of the third side wall 8, directly under the end of the rectangular spring tang 14.

The insert 19 works together with the spring tang 14, which provides additional centering force to the spring tang 14 and shares the stress load together with the spring tang 14 thus offering additional support when the end extension is being pushed as a result of the lateral displacement of the brake beam when the braking force is applied, thus avoiding the premature fracture of the unit guide wear plate tang.

Figure 6:
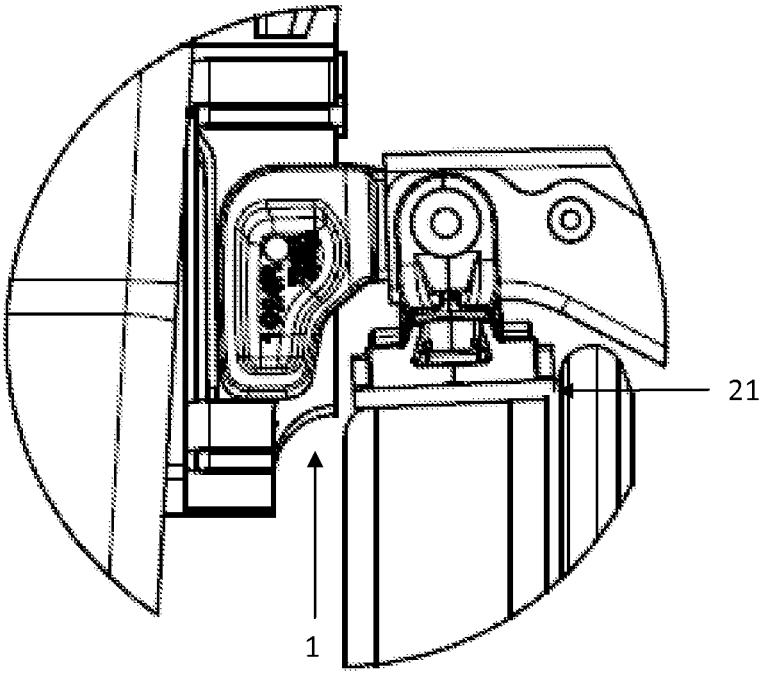
FIG. 6 is a view of a preferred embodiment of the unit wear plate of the present invention, installed in the truck of a railway car when the brakes are applied with worn brake shoes.

When the brakes are not applied (FIG. 4), the unit guide wear plate offers some clearance for the brake beam, allowing the free movement of the braking system and provides an increasing force for centering the brake beam as the brakes are applied (shown in FIG. 5, using new brake shoes 20), but avoiding stiffening the braking system and the truck rotation system. It further offers a positive displacement platform that pushes the brake beam backwards. FIG. 6 shows the unit wear plate when the brakes are applied with worn brake shoes 21.

Figure 7:
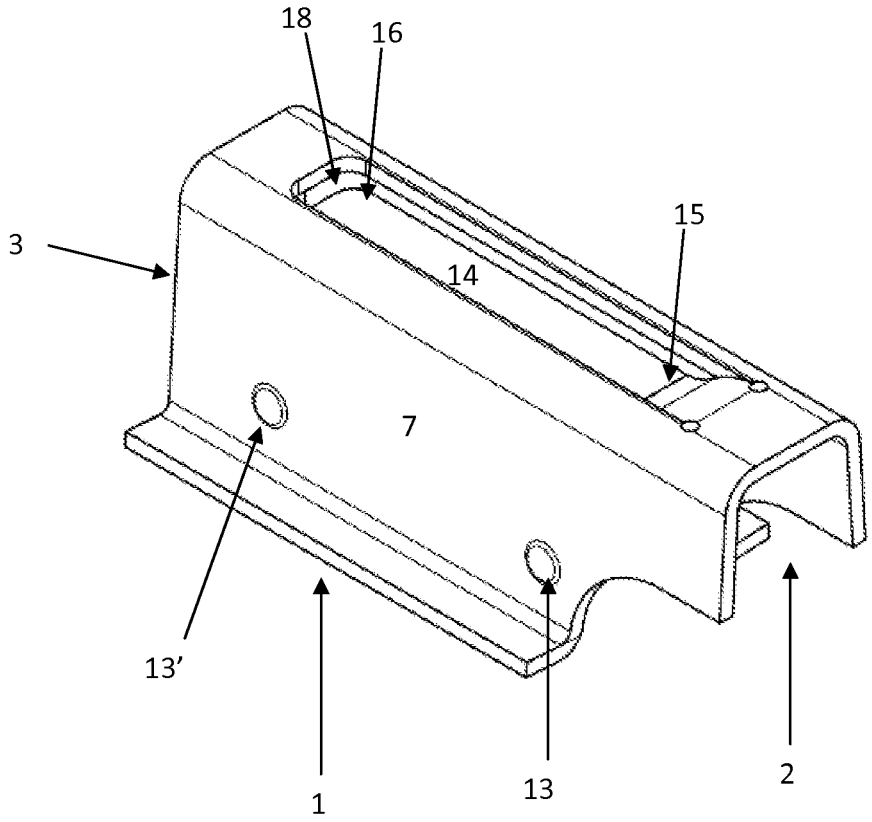
FIG. 7 is a lower perspective view of a second embodiment of the unit guide wear plate of the present invention.
Figure 8:
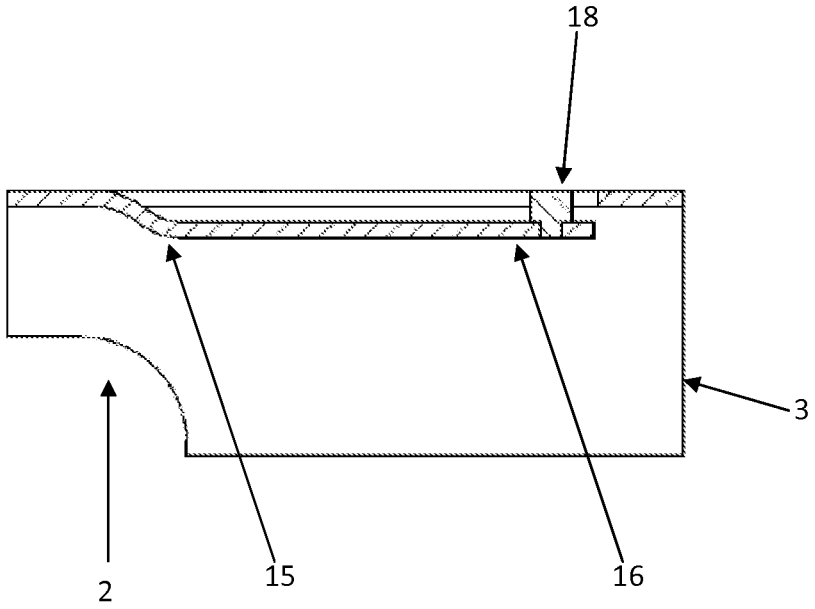
FIG. 8 is a view of the cross section of a second embodiment of the unit guide wear plate of the present invention.

In a second embodiment of the unit guide wear plate of the present invention (FIG. 7 and FIG. 8), the end 16 of the rectangular spring tang 14 faces towards the second open end 3 of the wear plate body 1 which offers the following advantages over the preferred embodiment of the invention:

- As the brake shoes 20 approach the wheels during braking operation, they bump with a more rigid spring tang, which is less elastic at its base, which corresponds to the greater decentring braking force that it needs to deal with.
- When the brakes are not applied, the braking mechanism is free to move, avoiding the "rigid truck" effect.

Figure 9:
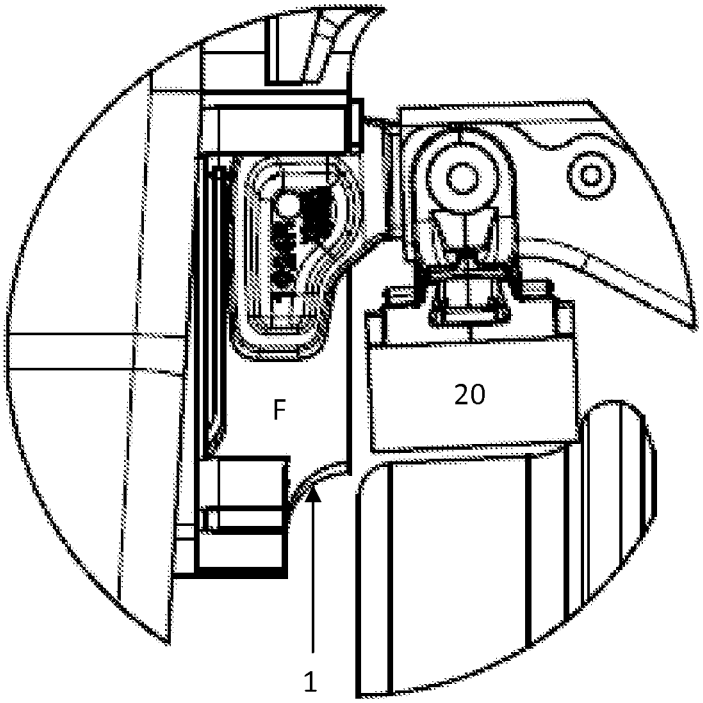
FIG. 9 is a view of a second embodiment of the unit wear plate of the present invention, installed in the truck of a railway car when the brakes are not applied.
Figure 10:
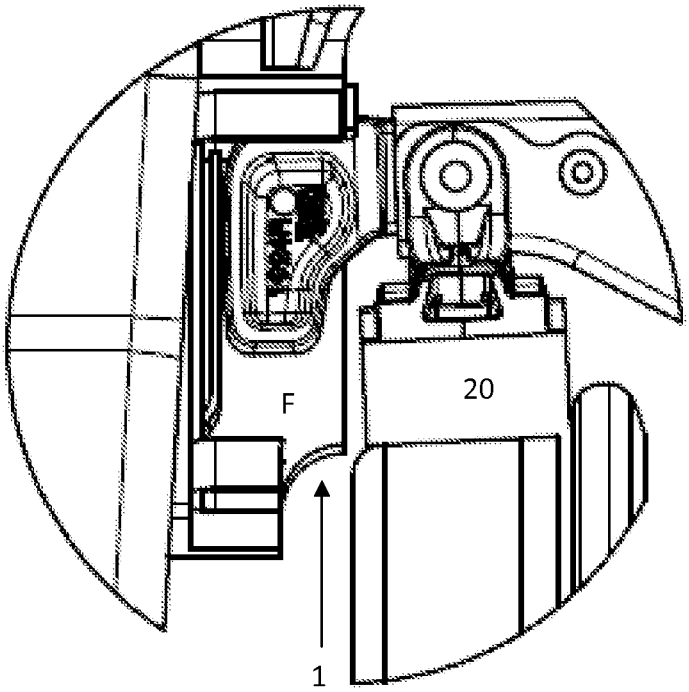
FIG. 10 is a view of a second embodiment of the unit wear plate of the present invention, installed in the truck of a railway car when the brakes are applied with new brake shoes.
Figure 11:
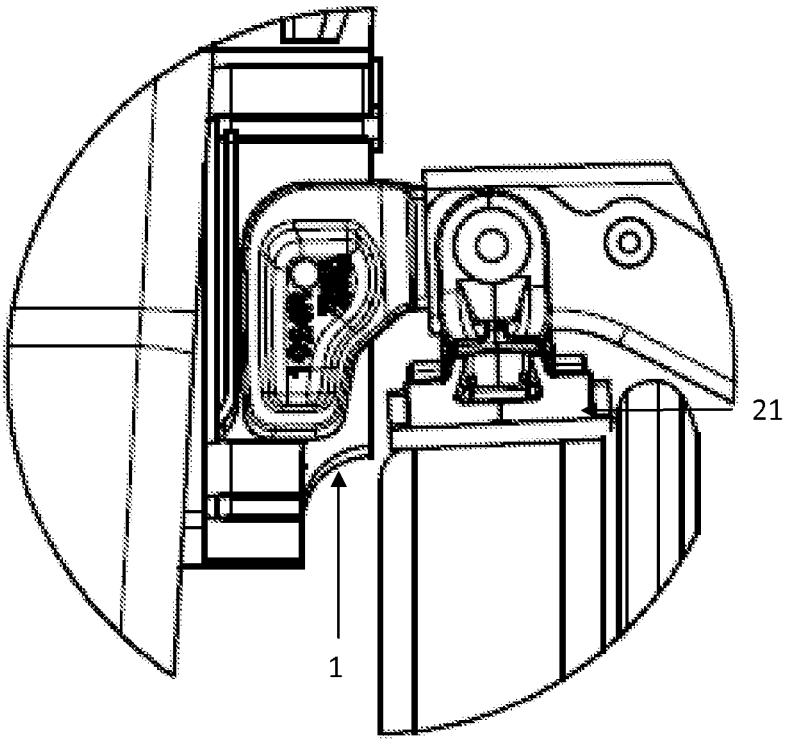
FIG. 11 is a view of a second embodiment of the unit wear plate of the present invention, installed in the truck of a railway car when the brakes are applied with worn brake shoes.

FIG. 9 shows the second embodiment of the unit wear plate when the brakes are not applied, FIG. 10 shows the second embodiment of the unit wear plate when the brakes are applied with new brake shoes 20 and FIG. 11 shows the second embodiment of the unit wear plate when the brakes are applied with worn brake shoes 21.

Figure 12:
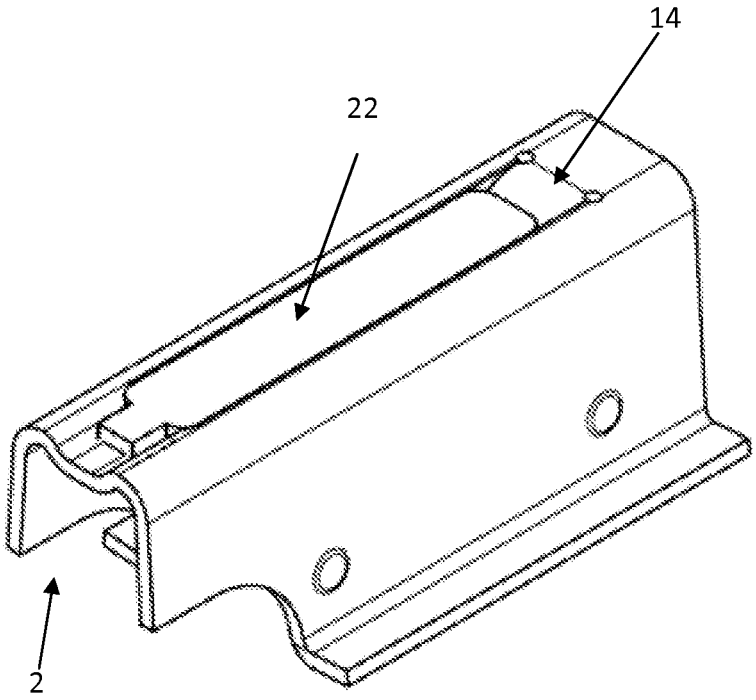
FIG. 12 is a lower perspective view of a third embodiment of the unit wear plate of the present invention.
Figure 13:
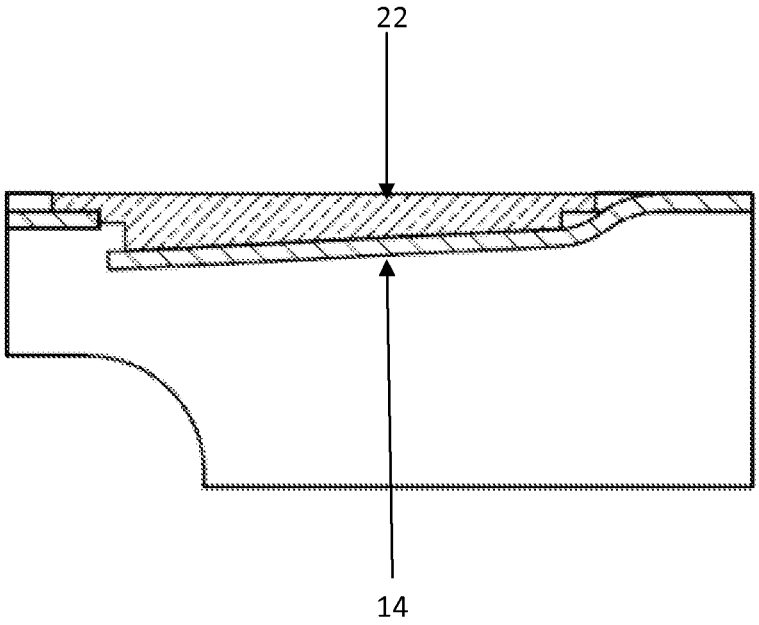
FIG. 13 is a view of the cross section of a third embodiment of the unit wear plate of the present invention.

FIG. 12 and FIG. 13 shows a third embodiment of the unit wear plate. In a third embodiment, the end 16 of the rectangular spring tang 14 faces towards the first open end 2 of the wear plate body 1 and the elastomeric material 22 of the centering means, extends along and below the spring tang 14 and has a inclined surface for receiving a lower surface of the spring tang. In the third embodiment the lower surface of the spring tang 14 always contacts the inclined surface of the elestomeric material 22, and when the brakes are applied the elastomeric material is compressed by the spring tang.

Finally it must be understood that the unit guide wear plate of the present invention, is not limited exclusively to the embodiments above described and illustrated and that the persons having ordinary skill in the art can, with the teaching provided by the invention, make modifications to the design of the unit guide wear plate of the present invention, which will clearly be within of the true inventive concept and of the scope of the invention which is claimed in the following claims.

The invention claimed is:

1. A unit guide wear plate for brake beams, comprising:

a wear plate body having a u-shaped cross section, a first open end and a second open end, and a first side wall having a first inner surface and a first outer surface;

a second side wall having a second inner surface and a second outer surface;

a third side wall having a third inner surface and a third outer surface, wherein the first side wall is located such that the first side wall is attached, by first joining region, to the third side wall opposite the second side wall, thereby forming the u-shaped cross section in such way that the distance between the first wall and second side wall is greater than the width of the third side wall;

a first flange extension protruding from the first side wall and a second flange extension protruding from the second side wall;

a pair of dimples arising out of the second outer surface for securing the unit guide wear plate within a railroad car side frame;

a spring tang for providing a lateral force on a brake beam end guide as the brake beam end guide lies within the unit guide wear plate body, said spring tang depending from the third side wall, said spring tang having a base and an end facing one of i) the first open end of the wear plate body and ii) the second open end of the wear plate body, the spring tang being lifted at an angle over the inner surface of the third side wall in such way that an aperture having the same shape as the spring tang is formed below said spring tang, said aperture having a first and a second end;

wherein the width of the rectangular spring tang is equal to the width of the third side wall from which it depends; and wherein the unit guide wear plate further comprises centering means attached at the third inner surface of the third side wall over the first end of the aperture, directly under the end of the spring tang, for supporting the end of the spring tang when the brake beam end guide pushes the spring tang during braking.

2. A unit guide wear plate for brake beams as claimed in claim 1, wherein the centering means comprises a rectangular plate having a first and a second surface and an insert made of an elastomeric material attached to a central portion of the first surface thereof, wherein said rectangular plate is attached at the third inner surface of the third side wall over the first end of the aperture, directly under the end of the rectangular spring tang.

3. A unit guide wear plate wherein the end of the rectangular spring tang faces towards the first open end of the wear plate body.

4. A unit guide wear plate wherein the end of the rectangular spring tang faces towards the second open end of the wear plate body.

* * * * *